US006238766B1

(12) United States Patent
Massett et al.

(10) Patent No.: US 6,238,766 B1
(45) Date of Patent: May 29, 2001

(54) MOISTURE BARRIER PROTECTION SYSTEM AND METHOD

(75) Inventors: Peter J. Massett, Playa del Rey; Paul J. Blasdel, San Juan Capistrano, both of CA (US)

(73) Assignee: Socopac, Co., San Juan Capistrano, CA (US)

( * ) Notice: Subject to any disclaimer, the term of this patent is extended or adjusted under 35 U.S.C. 154(b) by 0 days.

(21) Appl. No.: 08/965,467

(22) Filed: Nov. 6, 1997

(51) Int. Cl.[7] ..... E02D 19/00

(52) U.S. Cl. ..... 428/99; 52/169.14; 52/169.5; 405/52; 405/128; 405/270; 428/68; 428/101

(58) Field of Search ..... 428/99, 68, 101; 52/169.14, 169.5; 405/52, 128, 270

(56) References Cited

U.S. PATENT DOCUMENTS 4,343,847 8/1982 Maynard .
4,735,838 4/1988 Roberts .
4,917,537 4/1990 Jacobson .
5,406,759 4/1995 De Rosa .

*Primary Examiner*—Nasser Ahmad
(74) *Attorney, Agent, or Firm*—Henry G. Kohlmann

(57) ABSTRACT

A tough, high-strength geomembrane made from a custom blend of polyethylene copolymers, for protecting waterproofing courses from impact and pressure damage of debris resting against the waterproof course. A slip sheet configuration reduces surfaces stress due to earth movement and subsurface cracking thereby maintaining the protective course intact without any effect on the waterproofing layers. The geomembrane is available as lightweight rolls which can be easily be handled by one man. The film is installed horizontally in continuous sheets with few adhesive joints. Installation begins by applying a thick brush coat of the selected waterproofing membrane material (usually a rubber coat but may be any waterpoofing material). The film is unrolled along the wall, held up into position and secured using plastic self-sealing plugs and/or plastic termination bars. Concrete nails are used to attach the self-sealing plugs or termination bar to the wall. If termination bar is selected the film is extended up beyond the bar approximately 8" and folded down over the termination bar after attachment. Staples into the termination bar can be used to hold the film down creating a nicely detailed upper edge.

20 Claims, 7 Drawing Sheets

MOISTURE BARRIER PROTECTION SYSTEM AND METHOD

BACKGROUND OF THE INVENTION

1. Field of the Invention

The field of this invention relates to protective barriers used in construction. More specifically this invention relates to protective barriers used for protecting waterproof surface or coverings on below ground level structures. Such protective barriers prevent damage to the waterproof coating or surface.

2. Related Art

There are many related art water devices for covering or protecting surfaces from water penetration. These include waterproof coverings and coatings. Similarly there are numerous protective courses which are applied over the waterproof surface to protect it from damage by earth movement or rocks and debris on backfill. The most common of these is a polystyrene foam board covering which is inserted between the earth fill and the waterproof surface. However, these foam board coverings are inadequate as they deteriorate over time and are often damaged during installation, backfill and on earth movement allowing direct contact with the waterproofing surface.

Several other methods for protection of the waterproofing course are shown in the related art. These include ROBERTS (U.S. Pat. No. 4,735,838) wherein a membrane for waterproofing the building component includes a thin plastic strip in the range of 3 mils to 10 mils thick (5 mils is preferred), having an asphalt-elastomer blend having a thickness of about 30 to 100 mils thick (the commercial embodiment is about 55 mils thick) to cause the strip to adhere to the surface in question and provide the primary waterproofing. The plastic covering is primarily for the purpose of carrying the waterproof coating and is inadequate to prevent penetration of rocks and other debris. In addition, when such strips are applied they are unwieldy to handle, not unlike hanging wall paper, accordingly, they must be applied in relatively narrow strips. This results in multiple adhesive joints as discussed in ROBERTS. More joints provide more areas for failure. Finally once such sheets are applied they have a tendency to slide out of position either on installation of additional sheets or during backfill. As the thickness of the plastic sheet increases there is a likelihood of slippage simply due to gravity. That is likely why a thin 5 mil sheet is preferred.

JACOBSON (U.S. Pat. No. 4,917,537) shows a multiple panel lining system which has very short panels having an open mesh network supported by cables mounted on anchors. In this embodiment, the panels are draped over the cable to form an inner layer and an outer layer. First the inner layer and then the outer layer are then sprayed with the waterproofing sealant. No backfill or contact with earth or rocks is anticipated by this invention. Accordingly, no protective layer is provided and the panels are simply place holders for the sealant material which prevents leakage. Again many joints are provided which result in many potential points of failure.

MEYNARD (U.S. Pat. No. 4,343,847) teaches a limited slip sheet invention, which includes multiple sheets in the sealing adhesive, each of which are perforated to allow the sealing material to pass through the sheets. The entire assemblage is supported by a carrier. This provides an overall waterproof sandwich in which the two inner perforated layers may slide relative to one another in the event of cracking in the surface to be protected. The entire assembly is considered to be the waterproofing surface. In fact, the outer carrier sheet as well as the slip sheets becomes perforated by the hot adhesive which acts as the waterproof barrier during the process of manufacturing the assemblage and therefore the adhesive is exposed directly to earth movement, rocks and other potentially penetrating materials. The MEYNARD device appears intended for roofing.

DEROSA (U.S. Pat. No. 5,406,759) does not describe a protective membrane a such but teaches the measurement of the degree of debris penetration by emulating stone impacts in backfill situations. The patent discusses, but does not disclose, the use of four layer laminate. The patent describes the falling dart test procedure. These four layer structures comprise a carrier film and a waterproof laminate one applied over the other to form a first waterproof laminate, a first carrier, a second waterproof laminate and a second carrier. The inner carrier film has a thickness of 2 to 15 mils (disclosed in the preferred test environment as 7 mils) and the outer carrier film has a thickness of at least 0.25 mils. Interestingly, DEROSA states the PVC film or polyethylene film for the outer carrier, in the test environment is of 4 mils thickness. The waterproof laminate is a rubber bitumen composition having a thickness of 10 to 50 mils (disclosed in the preferred test environment as 25 mils). Multiple layers of the rubber bitumen are provided for such protection the carrier film has a Young's modulus of at least 200,000 PSI and preferably comprises poly(ethylene terephthalate). The DEROSA patent teaches that the inner layer between the two layers of waterproofing rubber or adhesive material provides the impact resistant quality of the combination which has a synergistic relationship when used in this specific combination and composition.

The above devices are either ineffective to protect the waterproof layer when applied, or the waterproof layer itself is a complex layering of materials which is difficult to install, expensive to make in material and manufacturing costs and expensive to use due to installation costs. Flexible sheets often form throats or gaps at the top thereof where they have pulled away from the surface to be protected during installation or during backfill. Rocks and debris enter these area's between the protective course and the wall and result in future damage and failure.

BRIEF DESCRIPTION OF THE INVENTION

The instant invention includes a tough, high-strength geomembrane made from a custom blend of polyethylene copolymers (POLXOLEFIN), which protects typical waterproofing courses from impact and pressure damage of debris resting against the waterproof course which can result from backfill and compaction or earth movement and cracks.

The manner of installation of the primary protective course described herein does not require any successive full course adhesive or multiple waterproofing layers and acts as a drainage surface, impermeability to water which directs water seepage to drain pipes typically installed at the foundation of subsurface structures.

A slip sheet configuration reduces surfaces stress due to earth movement and subsurface cracking thereby maintaining the protective course intact without any effect on the waterproofing layers. In fact, since the protective course is impermeable to water it augments the waterproofing course while protecting it.

The protective course sheet film is lightweight and available in rolls easily handled by one man. The film has a potentially indefinite life span if not exposed to sun light or oxygen significantly beyond the installation period.

The membrane is very flexible and is installed horizontally in continuous sheets with few adhesive joints. The installer may simply unroll the film along the ground or the upper surface to be protected to the desired length. Installation can be made in very narrow trenches as installation can be performed from above the base of the structure.

The film is commercially available. The film is highly puncture resistant and durable. Good tensile strength minimizes stretching on physical pressure and a high tear resistance of the film makes it resistant to splitting when pulled and manipulated during installation. A low temperature tolerance makes the film resistant to freeze and thaw cycles.

The film is impermeable to water based on characteristics of extruded polyethylene films generally and is resistant to chemical or environmental attack making it generally unaffected by acids, alkali and fungi found in soils, or trace chemicals or pollutants found in water.

The film is used in a unique configuration to prevent gaps at the upper surface thereof and is generally seamless horizontally. Additional layers of waterproofing are typically applied at potentially high leak areas, such as where the structure joins the foundation, and extends over and covers the foundation footer and cold joint and in other internal and external comer regions.

Installation begins by applying a thick brush coat of the selected waterproofing membrane material (usually a rubber coat but may be any waterpoofing material), taking care to cover and seal CMU block joints, pipe penetrations, voids, cracks, spalls, concrete rock pockets or any irregular surface on the CMU block or poured concrete wall. In addition, a thick brush of coat of material is applied to the cold joint at the base of the wall, (where the wall meets the footer), all inside and outside corners and any ledges or steps in the wall. While still tacky, a layer of 12" wide film (detail strip) is applied over the brush coat and then covered by a second layer of the selected waterproofing membrane. The primary waterproofing course is then applied to the entire foundation and wall.

A film forming the protection course is then attached to the wall. The film is unrolled along the wall, held up into position and secured using plastic self-sealing plugs and/or plastic termination bars. Concrete nails are used to attach the self-sealing plugs or termination bar to the wall. If a termination bar is selected the film is extended up beyond the bar approximately 8" and folded down over the termination bar after attachment. Staples into the termination bar can be used to hold the film down creating a nicely detailed upper edge. The film (protection course) lies directly against the waterproofing membrane. The waterproofing membrane is somewhat tacky and the protection course generally adheres to it during or following the installation process.

The backfilling operation will force the primary protection course film against the waterpoofing membrane and cause the film to adhere thereto. The self-sealing plugs and/or termination bar prevents any debris from entering between the film and the waterpoofing membrane.

At the base of the wall the protection course film is allowed to flow out over the footer onto the substratum. A drainage system is usually installed in this are to facilitate the removal of water. Inherent characteristics of the protection course film enhance the movement of water away from the wall and down to the drainage system. In essence, there are two layers of protection. The applied waterproofing membrane acts as primary waterproofing protection. The protection course film acts as a secondary waterproofing protection and the primary protection course. No other waterproofing system offers these advantages.

The primary protection course may be augmented by adding a second layer of protective course film which covers the first course. Installation is accomplished by stapling the second layer of film to the termination bar. No adhesive or other substance is introduced between the two sheets. If earth movement occurs, or the wall cracks the first and second course sheets will move or slip relative to one another and the waterproofing course will remain protected. Penetration resistance is greatly enhanced because of two layers of film.

Where the sealing of a seam is required this is accomplished by sealing the overlapped film with an adhesive tape made from the film itself or by heat sealing which melts the two sections to be joined together. Both horizontal and vertical seams may be sealed using either of the techniques described. Sheets of any desired width or length can be created by sealing sheets together which creates a continuous protective course for the waterproofing membrane.

DETAILED DESCRIPTION OF THE INVENTION

The instant invention includes a tough, high-strength geomembrane made from a custom blend of polyethylene copolymers (POLXOLEFIN), for example, which protects typical waterproofing courses from impact and pressure damage of debris resting against the waterproof course when can result from backfill and compaction or earth movement and cracks.

Figure 1:
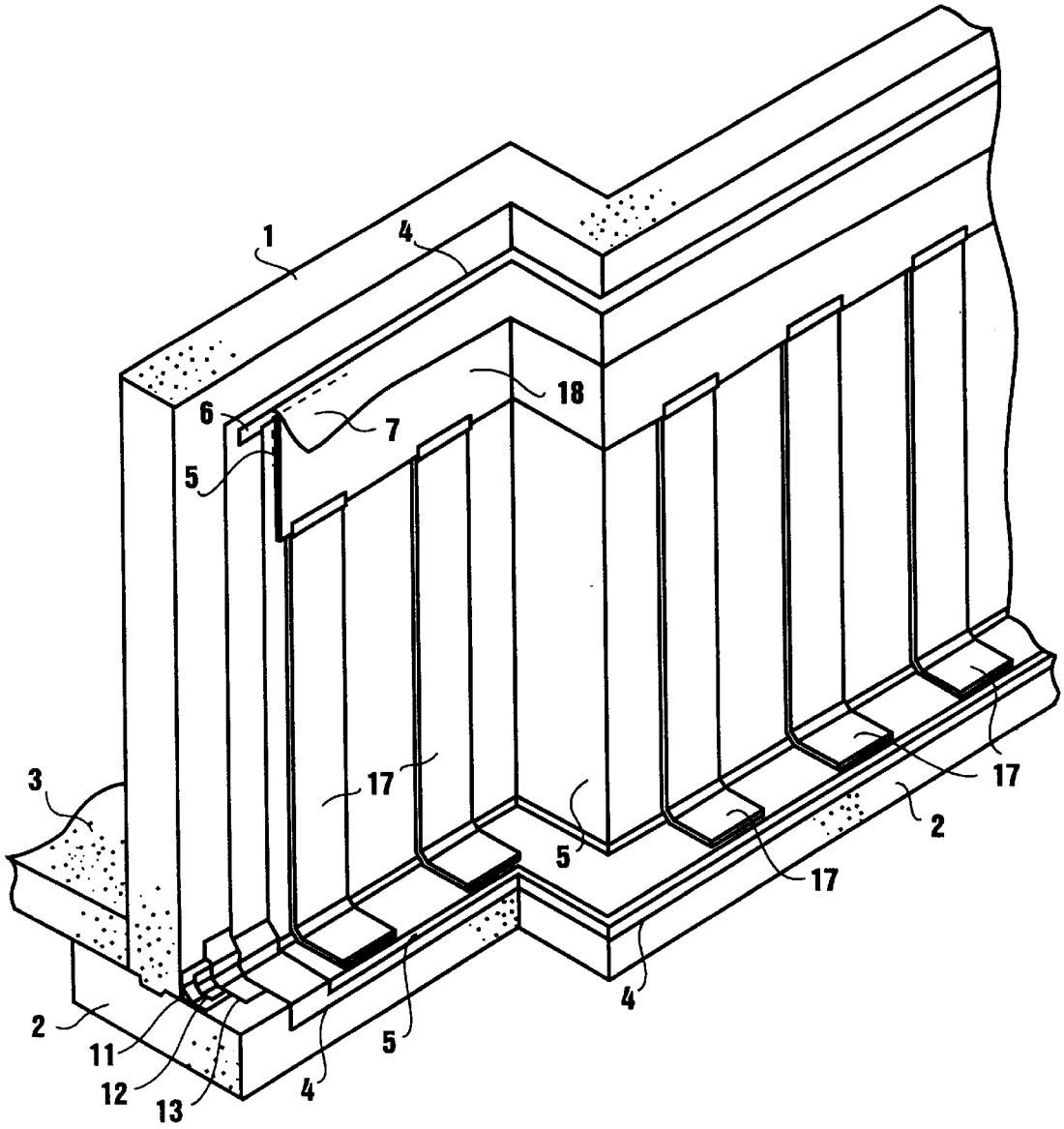
FIG. 1 is a perspective view of the protective course mounted on the surface of a structure.

Referring to the drawings, FIG. 1 shows the protective course installed on a vertical wall 1, keyed to a foundation 2. An inner floor 3 is adjacent the inside of the wall 1 and supported by the foundation 2. A primary waterproofing course 4 has been applied to the wall 1. The high-strength geomembrane film 5 of the instant invention is made from a blend of polyethylene copolymers having the characteristics herein described. The geomembrane film 5 is applied over all or nearly all of the waterproofing course 4 to protect it from impact and pressure damage of debris pressed against the waterproof course 4 as a result of backfill and compaction as well as earth movement and cracks which may occur after installation.

The primary protective course 5 does not require any multiple full course adhesive to remain in place. No multiple waterproofing layers are required due to the fact that the film 5 of the primary protective course is adequate to protect a single waterproofing layer 4 and acts as a drainage surface, impermeability to water as well, which directs water seepage to drain pipes typically installed at the foundation of subsurface structures.

Figure 2:
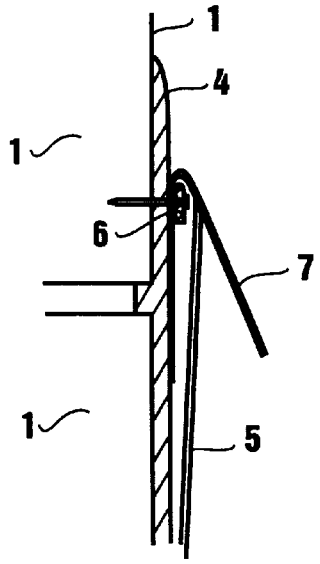
FIG. 2 is a side view of the overlapping termination skirt held in place by the nail strip and covering the primary protective sheet.
Figure 8:
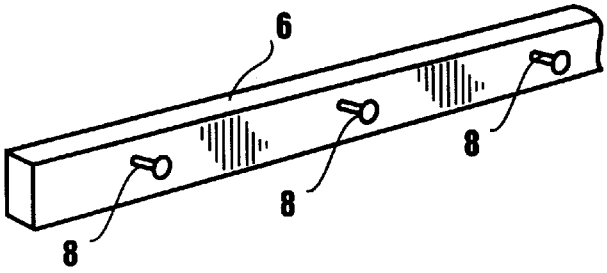
FIG. 8 is a perspective view of the nailing strip.

During installation of other prior coverings and protective boards, gaps are formed into which permit backfill debris to enter between the wall, in this case and the protective coverings which are eliminated in the instant invention. As shown in FIG. 1, a ridged supporting bar or nail strip 6 (preferably of wood) is affixed to the upper portion of the wall 1 just above ground level with concrete nails 8 (as shown in FIG. 8). A termination skirt 7, a strip of film approximately 12 inches wide, is fastened to the wall by the nail strip 6 and overlaps the nail strip 6 by approximately half its width. It is intended that the nail strip 6 be pre-nailed to provide a support for concrete nails required to fasten the nail strip to the wall. As shown in FIG. 8, the nails 8 should be spaced apart a distance appropriate to support the weight of the film, the termination skirt and any additional loads which may be applied to the nail strip 6. In this embodiment the nails 8 are spaced apart a distance of about three to four feet. The nail strip 6 has been designated as a wood bar and concrete nails 8 but other materials such as aluminum bars or plastic strips and any appropriate fastening devices may be used. Referring again to FIG. 1, the termination skirt 7 as used in the preferred embodiment is of the same material as the primary protective film 5 but since it its purpose is to prevent material from entering gaps, it may be made of any bendable or flexible material such as aluminum flashing and the width of the skirt 7 need be as wide as necessary under the particular circumstances to cover gaps in the primary protective layer 5 which may collect backfill debris and is not necessarily limited to 12 inches. For example, a covering of an aluminum flashing folded over the primary protective strip may need only be an inch or so in width due to its tendency to retain its folded shape when bent over the nail strip 6. FIG. 2 illustrates the disposition of the termination strip 7 over the primary protective course 5.

Figure 9:
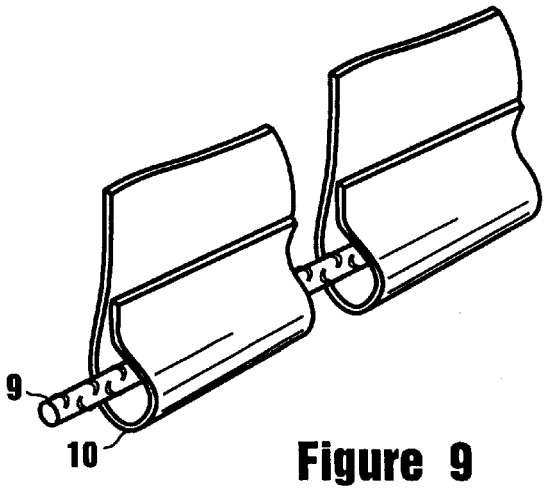
FIG. 9 is a perspective view of the bottom of the film heat sealed loop for re-bar.

The film 5 forming the primary protective course is attached under the termination strip 7 to the nail strip 6 at spaced intervals along its length of approximately every three to four feet by additional nails or staples, not shown. The film is lowered into the trench and generally adjusted to lie against the waterproofing course 4. The waterproofing course 4 is somewhat tacky and the protective course 5 generally adheres to it during the installation process. To aid in dropping the primary protective course 5 into place in the trench, particularly when a very narrow trench is present, a reinforcing bar section 9 as shown in FIG. 9 may be slipped into a channel at the bottom of the film formed by overlapping the lower section of the film 5 and heat sealing the film 5 to form a channel 10. The weight of the reinforcing bar 9 will then aid in controlling the bottom edge of the film 5 and minimize snagging of the film 5 on the waterproofing course 4 as it is dropped in the trench.

A backfill operation will force the primary protective film 5 against the waterproofing course 4 and cause the film 5 to adhere thereto and prevent any abrasive action due to relative movement between the film 5 and the waterproofing course 4.

Additional protective courses are installed at the transition point between the vertical wall and the foundation which forms an inside comer. As shown in FIG. 1 and in greater detail in FIG. 4, a first corner waterproofing course 11 is applied to the inside corner. A strip of film 12 approximately 6 inches in width is applied over the first comer waterproofing course 11. A second corner waterproofing course 13 is applied over the strip of film 12 and allowed to dry. The primary waterproofing course 4 is applied over the second corner waterproofing course 13 and the entire surface is ready for application of the primary protective course 5 as described above and shown in FIG. 1. A solid vertical wall 1 is shown in FIG. 1, however, as shown in FIGS. 4, 5, 10, 11 and 12 a block wall constructed of blocks 14 and mortar 15 may also be protected utilizing the instant invention.

Figure 5:
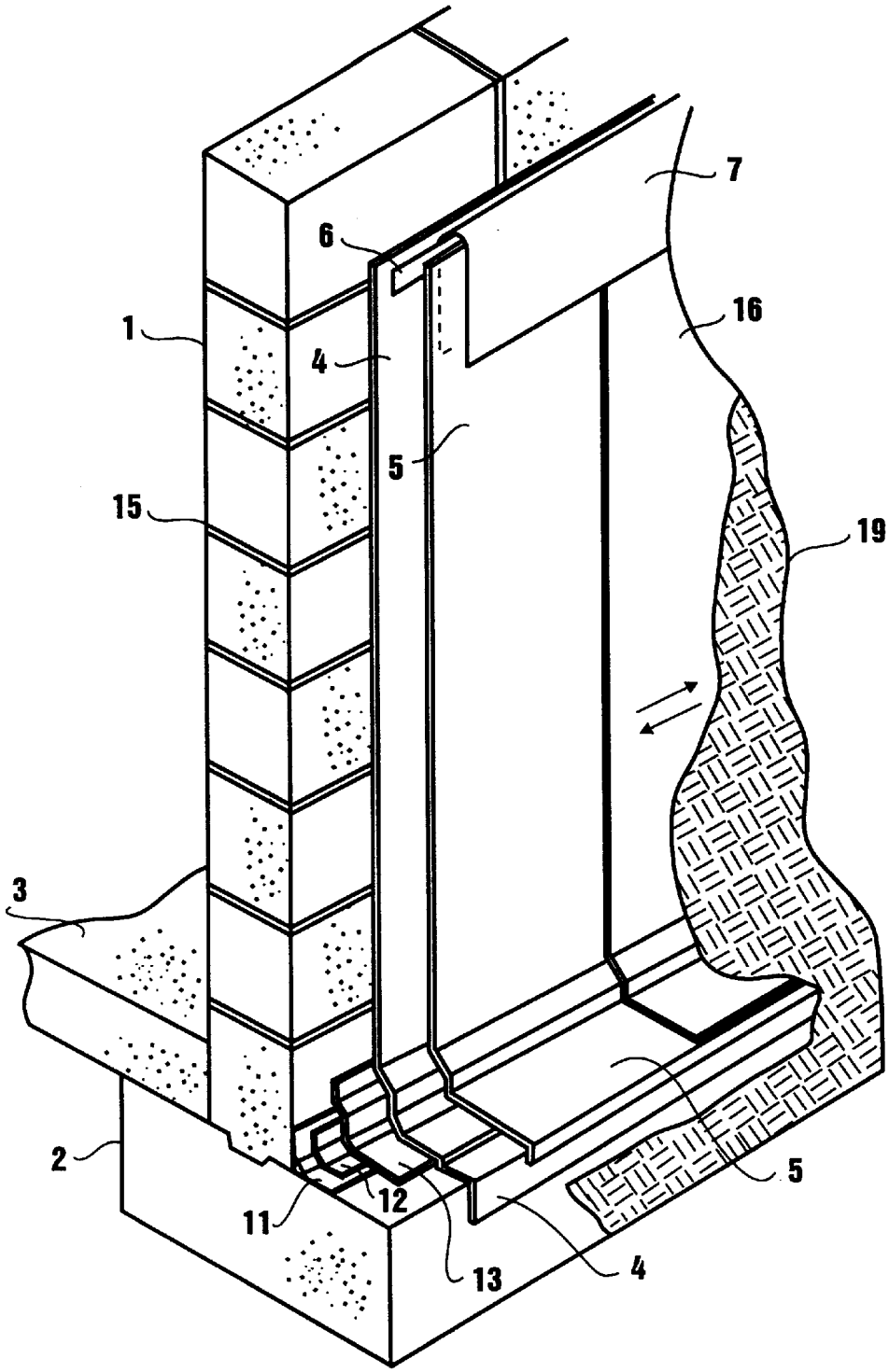
FIG. 5 is a perspective view of a block and mortar structure mounted on a foundation including the protective course with a slip sheet.

A slip sheet 16 configuration as shown in FIG. 5 reduces surfaces stress due to earth movement and subsurface cracking in the wall 1 thereby maintaining the primary protective course 5 intact without any effect on the waterproofing course 4. In fact, since the protective course 5 and the slip sheet 16 are impermeable to water the film and sheet augment the waterproofing course 4 while protecting it.

Figure 6:
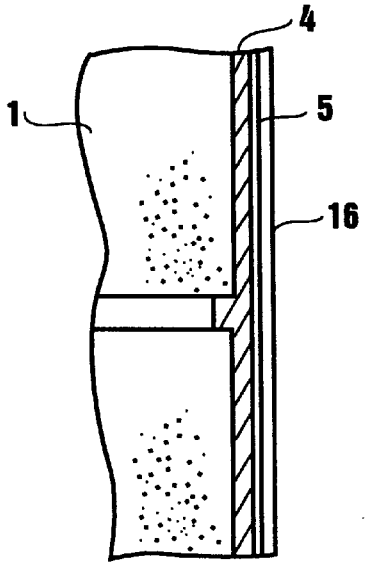
FIG. 6 is a side view of a block and mortar wall with a primary and slip sheet in place.
Figure 7:
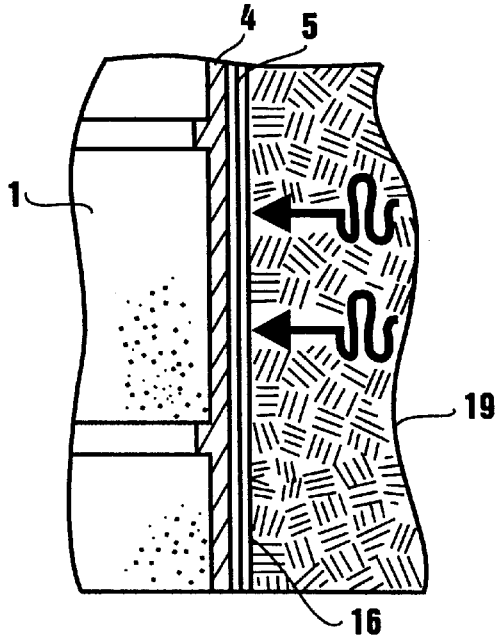
FIG. 7 is a side view of a block and mortar wall after backfill showing pressure point.

As shown in FIG. 5 the slip sheet 16 is mounted to the same nail strip 6 as is the primary protective course 5. No adhesive or other substance is introduced between the two sheets. If fill 19 movement occurs, shown here in the direction of the arrows, or the wall cracks the primary protective course 5 and the slip sheet 16 will slip relative to one another and the waterproofing course 4 will remain protected. Where the slip sheet 16 is made of the same material as the primary protective course, penetration resistance is doubled. FIG. 6 illustrates the initial placement of the primary protective course film 5 and the slip sheet 16. FIG. 7 shows the same view with backfill 19 in place.

The primary protective course film 5 is available in lightweight 12 ft×150 ft rolls, and may be provided in 20 foot roll widths. A 12 ft×150 ft roll is wound on a roll 3" in diameter, and 6 ft long (one fold) and weighs approximately 86 lbs, which can easily be handled by one man. The film has a potentially indefinite life span if not exposed to sun light or oxygen significantly beyond the installation period. The film is typically used in 10 mil thickness but up to 15 mil or greater may be used.

The film is very flexible and is installed horizontally in a generally continuous sheet with few adhesive joints. The installer may simply unroll the film along the ground or the upper surface to be protected to the desired length. Installation can be made in very narrow trenches of about one foot in clearance because of the ease of installation. Typically, trench area's of two feet or more are required simply to manipulate the protective course into position. More area is required if manual installation is required from within the trench. The need for a workman to be in the trench and hang the protective course of the instant invention on the wall is unnecessary as installation can be performed from ground level. The geomembrane film has a range of characteristics for protecting the applied waterproofing course which include, a puncture resistance in the range of about 15 lbs. to about 25 lbs.; a tensile strength of about 15 lbs. to about 25 lbs. a tear resistance of about 4 lbs. to about 8 lbs.; and a low temperature resistance down to about a negative 105 degrees Celsius.

The preferred film has a puncture resistance of 22.1 lbs ASTM D 4833, making it a durable film very resistant to penetration, a tensile strength of 21.9 lbs at 820% MD, ASTM D 882 minimizing stretching on physical pressure, a tear resistance of 6.01 lbs MD, ASTM D 1004 which will not split or crack when pulled during installation, and a temperature resistance to a negative 105 Celsius, ASTM D 1790 resulting in little if any impact on the film during freeze and thaw cycles.

The film is impermeable to water based on characteristics of extruded polyethylene films generally and is resistant to chemical or environmental attack making it generally unaffected by acids, alkali and fungi found in soils, or trace chemicals or pollutants found in water.

The film is used in the unique configuration described above prevents gaps at the upper surface thereof and is generally seamless. Additional layers of waterproofing and film layering are typically applied to potentially high leak areas, such as where the structure joins the foundation, in overlapping the foundation and in other internal and external corner regions is as shown and described for FIGS. 1 and 4.

Figure 3:
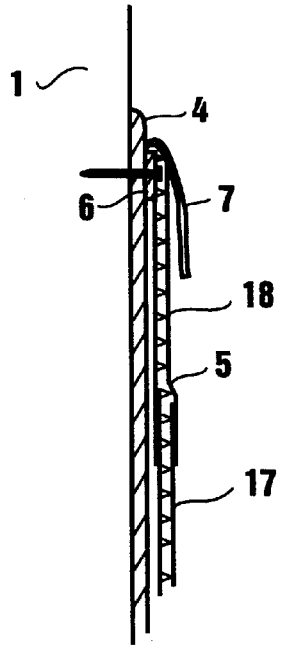
FIG. 3 is a side view similar to that of FIG. 2 showing the addition of the drainage mats.
Figure 4:
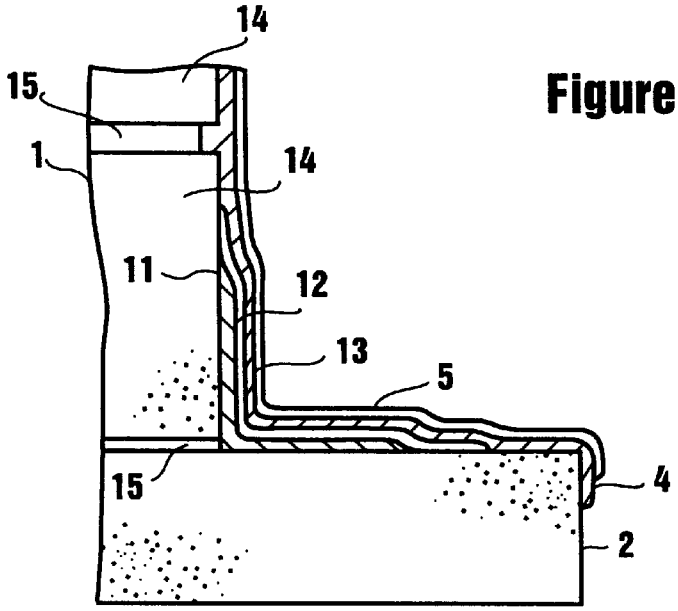
FIG. 4 is a side view of the multiple protective course at the transition of the upright structure to the foundation.

As shown in FIG. 1, drainage mats may also be included. FIG. 1 shows a plurality of vertical chimney drainage mats 17 placed against the primary protective film course with the upper section of the chimney drainage mats 17 opened and in communication with a horizontal drainage mat 18 which. is position below the nail strip 6 with the upper portion thereof covered by the termination strip 7. If a slip sheet 16 is included as shown in FIG. 5, then the drainage mats would be placed on the outside of the structure against the outer slip sheet 16. FIG. 3 illustrates the disposition of the termination strip 7 over the primary course 5 when drainage mats 17 and 18 are in place.

Where a seam is required this may be sealed using an adhesive or by heat sealing which melts the two sections to be joined together. In fact, if continuous sheets are required for the roofs of tunnels and the like, multiple rolls of the film may be heat sealed together to make a sheet of any width or length desired which is water impermeable and forms a continuous protective course for the waterproofing course.

Figure 10:
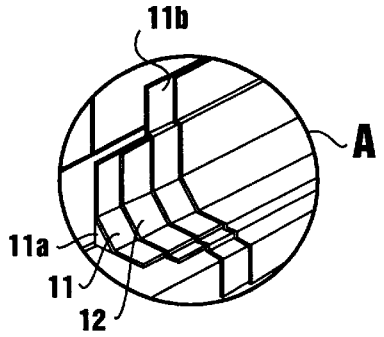
FIG. 10 is a perspective view of the wall to be protected showing surface defects.
Figure 10:
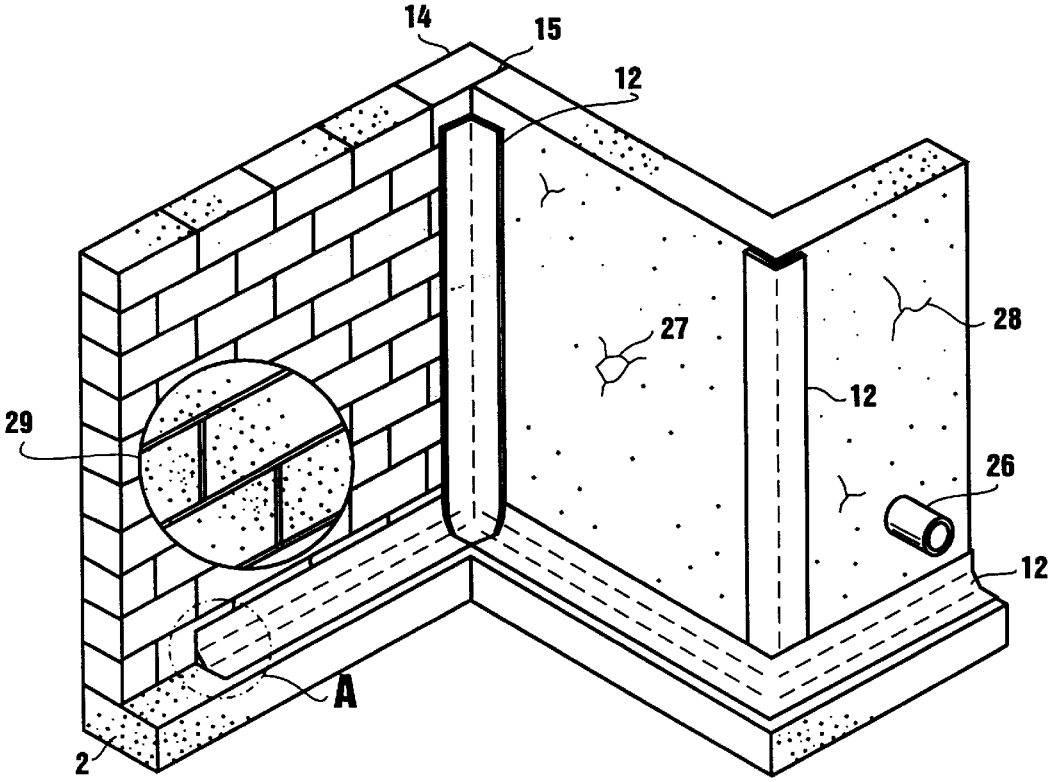
Figure 11:
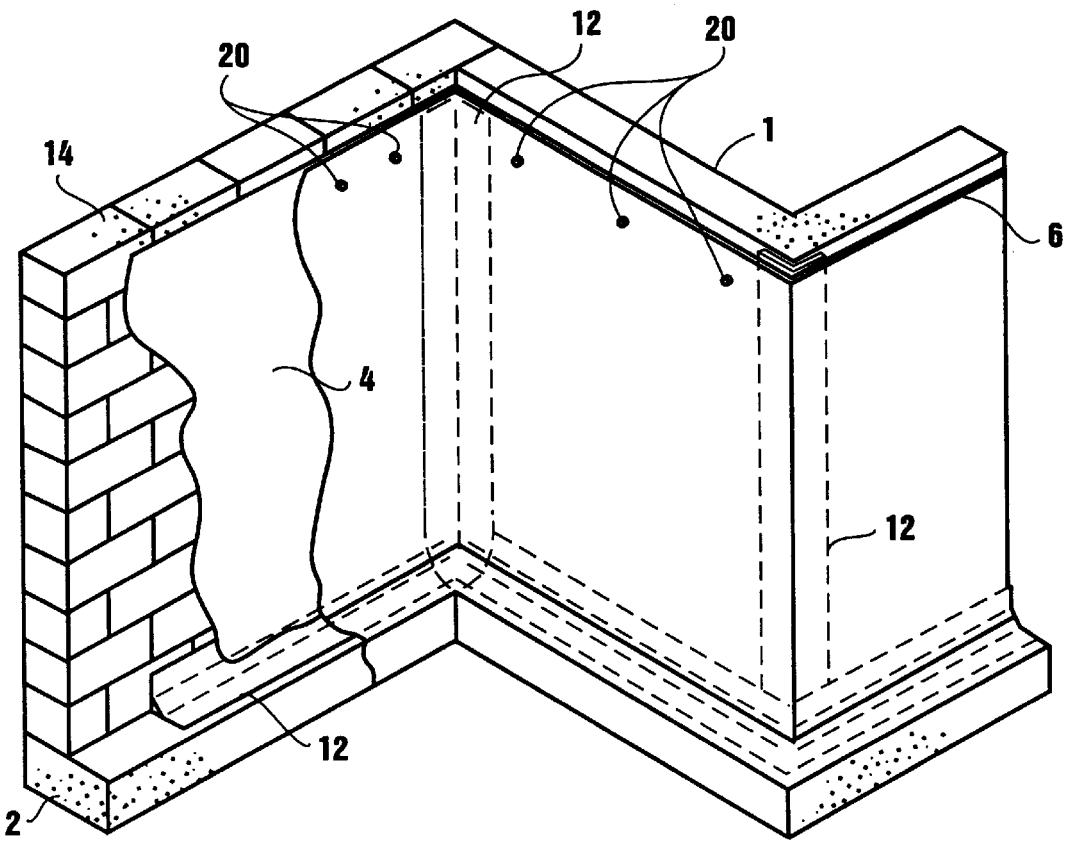
FIG. 11 is a perspective view of the wall to be protected with the protective course.
Figure 12:
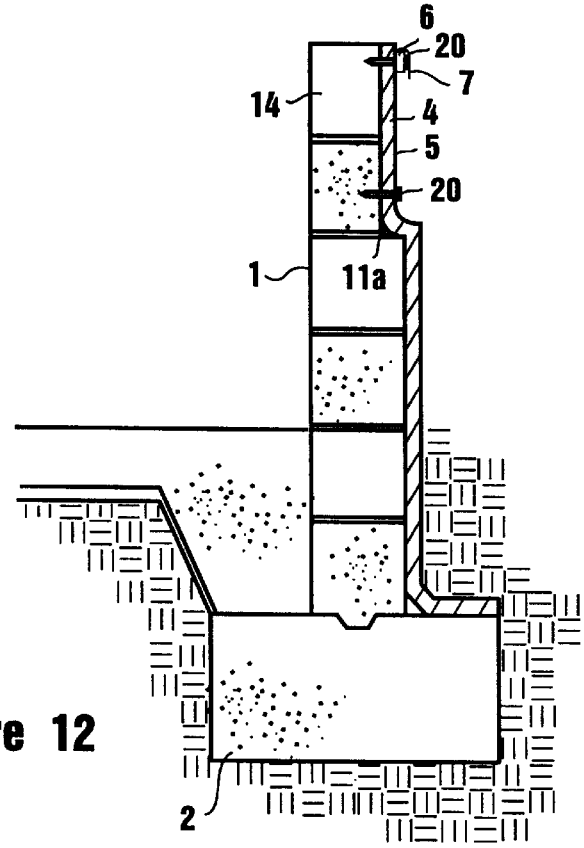
FIG. 12 is a side view of a wall with a protective course and filled areas.

In an alternative method and embodiment as shown in FIGS. 10–14B, a bar 6 is utilized at the top of the wall 1. As shown in FIG. 12, the termination bar 6 overlaps the film 5 and the protective course 4 and the termination skirt 7 overlaps the bar 6.

However, as shown in FIG. 11, a plurality of self sealing plugs 20 which are held in place by nails 8 are also used. Such plugs 20 may be used at various points such as at or near ledges such as is shown in FIG. 12 or on initial positioning prior to fastening the bar 6 in place as shown in FIG. 11. In some installations the seal sealing plugs 20 may be the only fastener used.

Figure 13:
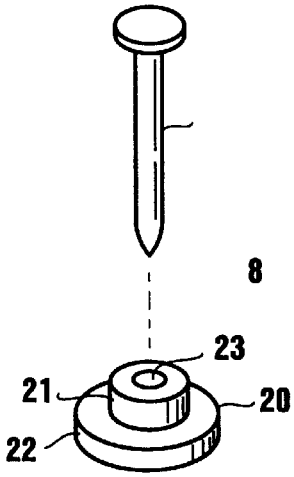
FIG. 13 is a perspective view of a sealing plug and a concrete nail.
Figure 14A:
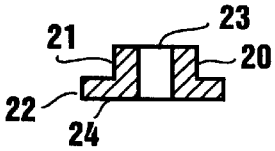
FIGS. 14A and 14B are side views of the sealing plug.
Figure 14B:
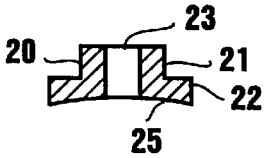

The self sealing plugs 20 are made of a resilient flexible material which resists impact deformation when being nailed into place. High Density Polyethylene (HDPE) material would suffice, however, any other similar material can be used. The self sealing plug 20 has two sections basically for conservation of material and added flexibility. As shown in FIGS. 13, 14A and 14B an upper circular section 21, is made integral with a cylindrical disk 22 and concentric therewith. A nail hole 23 extends through the center thereof and is preferably smaller in diameter than a concrete nail 8 such that a sealing effect is realized when a nail 8 is driven through the plug 20. The lower surface 24 of the self sealing plug 20 is smooth so that the entire area of the lower surface will be in contact with the film 5 when the plug 20 is nailed in place. Compression of the plug 20 on nailing the same to the wall seals the hole in the film caused by penetration of the nail 8. This occurs by sealing the area around the nail 8 in the hole 23 as noted above and by compressing the lower surface 24 of the plug 20 against the film 5. No additional adhesive is required.

Further, as shown in FIG. 14B, the lower surface 25 of the plug 20 may be slightly concave thereby increasing the compression around the nail 8 and around the periphery of the plug 20 at the surface of the film 5. In either case the lower surface 24 and 25 should be smooth. This particular structure prevents damage to the surface of the film 5

A single washer of a thickness of about 0.3 to 1 cm may also be used, however, where the lower surface is concave, more compressive force is then required to complete the seal due to a greater amount of material between the upper and lower surface 24 and 25 of the plug 20 which must be deformed and care must be taken in choosing the material from which the washer is made to avoid damage to the film.

The preferred size of the plug 20 is about a 1 cm diameter for the upper section 21 and a thickness of about 0.5 cm and a 2 cm diameter for the lower section with a thickness of about 0.3 cm.

Referring to FIG. 10, the installation process begins by applying a thick brush coat of the selected waterproofing membrane material 11 (usually a rubber coat but may be any waterpoofing material), taking care to cover and seal CMU block joints 15, pipe penetrations 26, voids 27, cracks 28, spalls, concrete rock pockets 29 or any irregular surface on the CMU block or poured concrete wall 1 as shown in FIG. 10. In addition, a thick brush of coat of waterproofing material is applied to the cold joint 11 a at the base of the wall, (where the wall meets the footer) and all inside and outside corners and any ledges or steps in the wall. While the waterpoofing material is still tacky, a layer of 12" wide film (detail strip 12) is applied over the brush coat and then covered by a second layer of the selected waterproofing material 11*b*. The primary waterproofing course 4 is then applied to the entire foundation and wall.

The film 5 forming the protection course is then attached to the wall 1. The film 5 is unrolled along the wall 1, held up into position and secured using plastic self-sealing plugs 20 and/or plastic termination bar 6. concrete nails 8 are used to attach the self-sealing plugs 20 or the termination bar 6 to the wall. If termination bar 6 is selected the film 5 is extended up beyond the bar approximately 8" and folded down over the termination bar after attachment. Alternatively, a termination strip 12 may be used as described above. Staples may be driven into the folded down portion 7 as shown in FIG. 12 and into the termination bar to hold the film 7 down creating a nicely detailed upper edge. The film 5 (protection course) lies directly against the waterproofing membrane 4. The waterproofing membrane 4 is somewhat tacky and the protection course film 5 generally adheres to it during or following the installation process.

The backfilling operation will force the primary protection course film 5 against the waterpoofing membrane 4 and cause the film 5 to adhere thereto. The self-sealing plugs 20 and/or termination bar 6 prevents any debris from entering between the film 5 and the waterpoofing membrane 6.

At the base of the wall 1 the protection course film 5 is allowed to flow out over the footer 2 onto the substratum. A drainage system is usually installed in this area to facilitate the removal of water. Inherent waterproof characteristics of the protection course film 5 enhance the movement of water away from the wall 1 and down to the drainage system. In essence, there are two layers of protection. The applied waterproofing material 4 acts as primary waterproofing protection. The protection course film 5 acts as a secondary waterproofing protection and the primary protection course.

The primary protection course may be augmented by adding a second layer of protective course film 16 which covers the first course film 5 as previously described. Installation is accomplished by also stapling the second layer of film 16 to the termination bar 6. No adhesive or other substance is introduced between the two sheets of film. If earth movement occurs, or the wall cracks the first and second course sheets 5 and 16 will move or slip relative to one another and the waterproofing course 4 will remain protected. Penetration resistance is greatly enhanced because of two layers of film.

Where the sealing of a seam is required this is accomplished by sealing the overlapped film with an adhesive tape made from the film 5 itself or by heat sealing which melts the two sections to be joined together. Both horizontal and vertical seams may be sealed using either of the techniques described. Sheets of any desired width or length can be created by sealing sheets together which creates a continuous protective course for the waterproofing membrane.

Having thus described the invention what is claimed is:

1. A protection system for a construction surface having a waterproofing course covering at least a portion thereof comprising:

a. a fastener strip having a plurality of fasteners adapted for fastening said fastener strip to said construction surface;

b. a top termination strip, at least a portion of which is secured to said construction surface by said fastener strip and a portion of which overhangs said fastener strip and covered in part by said overhang of said top termination strip, c. A first film for covering and protecting said waterproofing course fastened to said fastener strip and covered in part by said overhang of said top termination strip.

2. A protection system as described in claim 1 wherein said system further includes a second film for covering at least a portion of said first film, also fastened to said fastener strip and covered in part by said overhang of said top termination strip.

3. A protection system as described in claim 1 wherein said construction surface is supported by a support surface contiguous with said construction surface and said system further includes a base strip of film at the point of transition from said construction surface to said support surface disposed underneath said first film.

4. A protection system as described in claim 3 wherein said base film covers at least a first portion of a waterproofing course at said transition point, and a second portion of a waterproofing course is disposed between said base film and said first film.

5. A protection system as described in claim 1 wherein said film comprises a polyethylene sheet of material having a thickness between 10 mils and 20 mils.

6. A protection system as described in claim 1 wherein said film has:

a. a puncture resistance in the range of about 15 lbs to about 25 lbs;

b. a tensile strength of about 15 lbs to about 25 lbs;

c. a tear resistance of about 4 lbs to about 8 lbs; and d. a low temperature resistance down to about a negative 105 Celsius.

7. A protection system as described in claim 1 wherein said film comprises a blend of polyethylene copolymers.

8. A protection system for a construction surface having a waterproofing course covering at least a portion thereof comprising:

a. a wood strip having a plurality of present nails adapted for fastening said strip to said construction surface;

b. a top termination strip, at least a portion of which is secured to said construction surface by said wood strip and a portion of which overhangs said wood strip; and c. a first film for covering and protecting said waterproofing course fastened to said fastener strip and covered in part by said overhand of said top termination strip.

9. A protection system as described in claim 8 wherein said system further includes a second film for covering at least a portion of said first film, also fastened to said wood strip and covered in part by said overhang of said top termination strip.

10. A protection system as described in claim 8 wherein said construction surface is supported by a support surface contiguous with said construction surface and said system further includes a base strip of film at the point of transition from said construction surface to said support surface disposed underneath said first film.

11. A protection system as described in claim 10 wherein said base film covers at least a first portion of a waterproofing course at said transition point, and a second portion of a waterproofing course completely covers said base film and is disposed between said base film and said first film.

12. A protection system as described in claim 1 wherein said film comprises a polyethylene sheet of material having a thickness between 10 mils and 20 mils.

13. A protection system as described in claim 8 wherein said film has:

a. a puncture resistance of about 22.1 lbs;

b. a tensile strength of about 21.9 lbs;

c. a tear resistance of about 6.01 lbs; and d. a temperature resistance down to about a negative 105 Celsius.

14. A protection system as described in claim 1 wherein said film comprises a blend of polyethylene copolymers.

15. A protection system for a surface having a waterproofing course covering at least a portion thereof comprising:

a. a fastener plug for attachment to said surface having a gripping area and a hole for receiving a fastener; and b. A first film for covering said waterproofing course fastened to said surface with at least one unitary fastener gripping said first film at said gripping area.

16. A protection system as described in claim 15 wherein there are a plurality of fastener plugs spaced apart and attached to said surface with said gripping area biased against said film.

17. A fastener plug as described in claim 15 wherein said fastener plug further comprises:

a. a first section having a gripping area which is larger than said fastener for engaging said film; and b. a second section having a base area larger than said fastener and smaller than said first section.

18. A fastener plug as described in claim 17 wherein said gripping area of said first section has a smooth concave surface and said first section is sufficiently flexible to permit deformation of said first section concave surface into a geometry which permits contact of the film across a significant portion of said smooth surface of said gripping area.

19. A fastener plug as described in claim 18 wherein said plug is made from a generally resilient material.

20. A fastener plug as described in claim 19 wherein said plug is made from High Density Polyethylene (HDPE).

* * * * *